United States Patent [19]

Hampton

[11] Patent Number: 4,850,909

[45] Date of Patent: Jul. 25, 1989

[54] OUTBOARD JET FOOT PROTECTOR

[76] Inventor: Douglas R. Hampton, 597 E. 600 North, Firth, Id. 83236

[21] Appl. No.: 100,421

[22] Filed: Sep. 24, 1987

[51] Int. Cl.[4] ..... B63H 11/01

[52] U.S. Cl. ..... 440/46

[58] Field of Search ..... 60/221, 222; 440/38–43, 46

[56] References Cited

U.S. PATENT DOCUMENTS 3,055,175 9/1962 Clark ..... 440/41

3,367,116 2/1968 Stallman ..... 440/46 X

*Primary Examiner*—Sherman D. Basinger

*Attorney, Agent, or Firm*—Fleit, Jacobson, Cohn, Price, Holman & Stern

[57] ABSTRACT

A downward tubular extension constructed of shape retentive, but resilient, material is mounted from the lower end of the water inlet casing of a water jet pump of the outboard-type and the pump is mounted from the transom of an associated boat in elevated position thereon corresponding to the effective vertical extent of the extension. The extension is mounted from the lower end of the water inlet casing through the utilization of upwardly projecting mounting ears received in front and rear wall downwardly opening slots in the casing lower end in which the opposite ends of trash bars are conventionally mounted and the conventional trash bars are mounted in corresponding slots formed in the lower ends of the front and rear walls of the extension at the lower end thereof.

6 Claims, 2 Drawing Sheets

OUTBOARD JET FOOT PROTECTOR

BACKGROUND OF THE INVENTION

1. Field of the Invention

This invention relates to the provision of a shape retentive, resilient downward tubular extension of the downwardly opening trash bar equipped inlet of an outboard-type of water jet motor for small boats to absorb shock upon striking an underwater object in shoal waters and to prevent damage to the water inlet housing of the water jet motor disposed above the downward extension in the event of striking an underwater object, the trash bars of the water inlet housing of the water jet motor being removed and carried by the lower end of the resilient downward extension and the mounting height of the water jet outboard motor being increased an amount substantially equal to the effective vertical extent of the downward resilient extension for the water inlet housing.

2. Description of Related Art

Various different forms of water jet motors of the outboard type heretofore have been provided and protective water inlet fittings for throughbottom jet water inlets are also known. Examples of these various are disclosed in U.S. Pat. Nos. 3,035,409, 3,082,732, 3,367,116, 4,055,140 and 4,237,812. However, these previously known devices do not offer impact resistance to the downwardly opening water inlet housing of an outboard-type of water jet pump.

SUMMARY OF THE INVENTION

The instant invention resides in the provision of a resilient material and tubular downward extension for the trash bar equipped downwardly opening water inlet of an outboard-type of water jet pump in order that the shock of impact of the resilient material downward extension of the water inlet with an underwater object will not befully transmitted to the water inlet housing of the outboard-type of water jet pump. In addition, the trash bars of the existing water jet pump inlet housing are removed, the mounting structure for the original trash bars is used to mount the resilient material downward extension from the water inlet housing and the removed trash bars are remounted on the lower end of the resilient material downward extension. Further, the mounting height of the outboard-type of water jet pump is increased an amount generally equal to the effective vertical height of the downward extension.

The main object of this invention is to protect the water inlet casting of an outboard-type of water jet pump from high impact shocks due to impact with underwater objects.

Another object of this invention, in accordance with the immediately preceding object, is to provide a resilient material and tubular downward extension for the water inlet casting of an outboard-type of water jet pump and to increase the mounting height of the water jet pump an amount generally equal to the effective vertical extent of the downward extension.

Yet another object of this invention is to provide the protective resilient material downward extension for the water inlet housing with trash bars to prevent the entrance of trash into the water jet pump.

Another very important object of this invention is to utilize the existing trash bar mounting structure of the water inlet casting for mounting the resilient material tubular extension to the water inlet casting after removal of the original trash bars and to utilize the original trash bars on the lower end of the resilient material downward extension.

A final object of this invention to be specifically enumerated herein is to provide a resilient material tubular downward extension for the water inlet casting of an outboard-type of water jet pump and with the extension conforming to conventional forms of manufacture, being simple to use and economically feasible.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
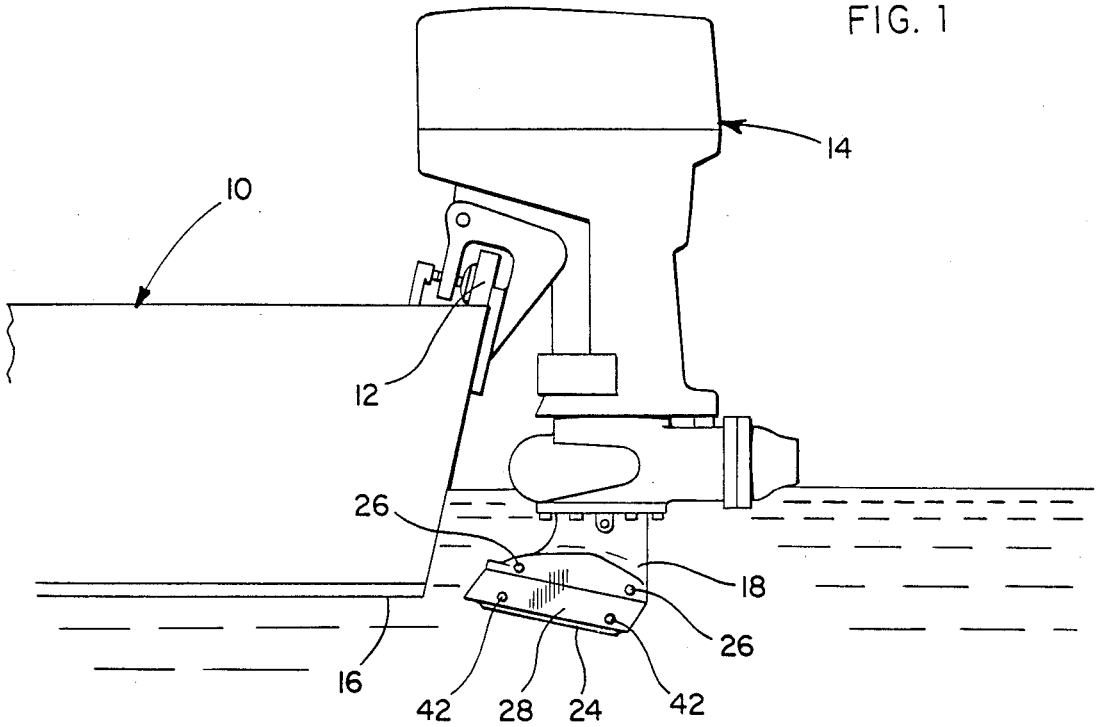
FIG. 1 is a left side elevational view of the stern portion of a lightweight boat having a conventional form of outboard motor-type of water jet pump mounted in slightly elevated position thereon and with the water inlet housing or casting of the water jet pump equipped with the resilient material tubular downward extension of the instant invention.
Figure 2:
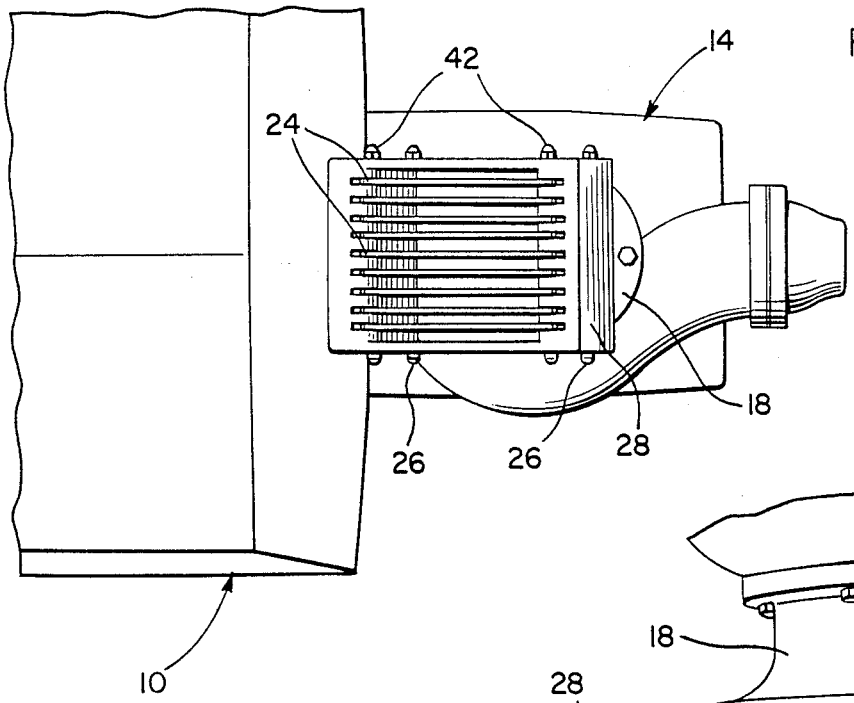
FIG. 2 is a fragmentary enlarged bottom plan view of the assembly illustrated in FIG. 1.
Figure 3:
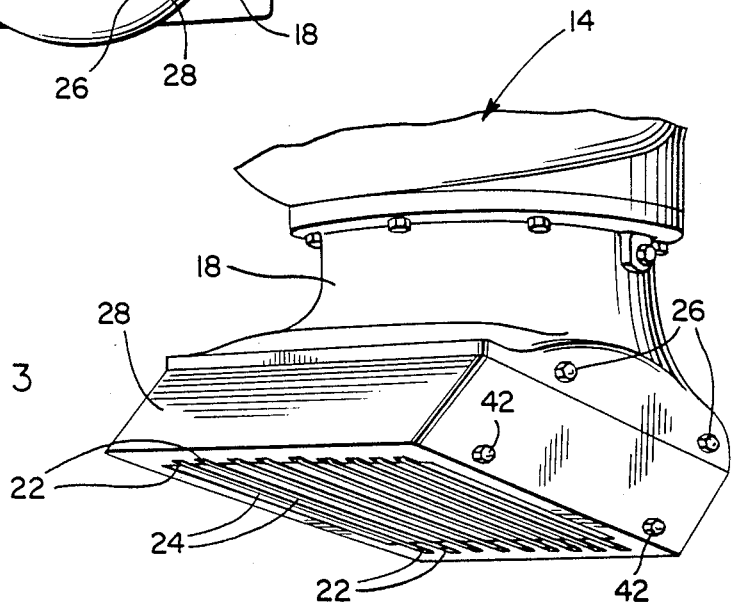
FIG. 3 is a fragmentary enlarged perspective view of the water jet inlet casting for the water jet pump and with the resilient tubular extension of the instant invention operatively mounted thereon.
Figure 4:
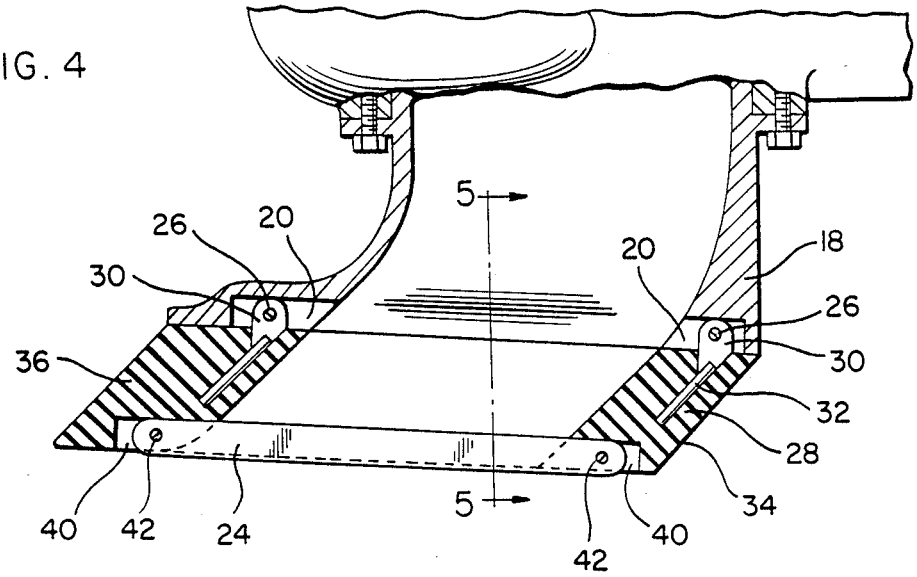
FIG. 4 is a fragmentary vertical sectional view of the water inlet casting of the water jet pump and with the resilient downward extension mounted thereon.
Figure 5:
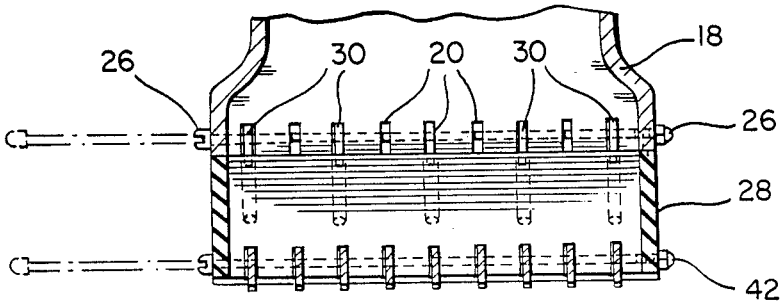
FIG. 5 is a transverse vertical sectional view taken substantially upon the plane indicated by the section line 5—5 of FIG. 4.
Figure 6:
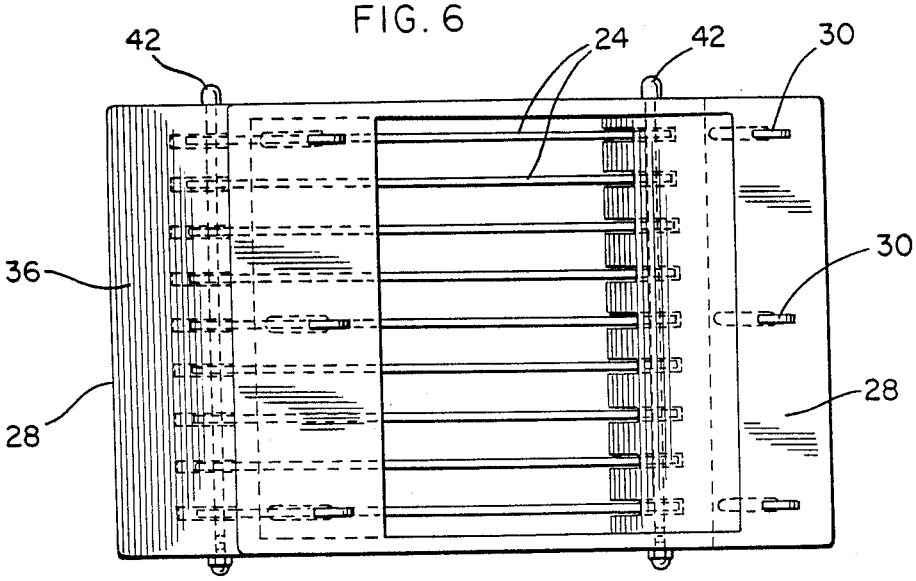
FIG. 6 is a top plan view of the assemblage illustrated in FIG. 4.

Referring now more specifically to the drawings, the numeral 10 generally designates a conventional form of lightweight boat including a transom 12 upon which a conventional outboard-type of water jet pump referred to in generaly by the reference numeral 14 is mounted. The mounting height of the water jet pump 14 is slightly increased relative to the bottom 16 of the boat 10 for a purpose to be hereinafter more fully set forth.

The water jet pump 14 includes a lower water inlet casting or casing 18 which opens downwardly and includes a plurality of transversely spaced front and rear downwardly opening slots 20 (similar to those designated at 22 in U.S. Pat. No. 3,367,116).

Conventionally, the opposite ends of trash bars 24 (similar to those designated at 21 in U.S. Pat. No. 3,367,116) are secured in the slots 20 through the utilization of transversely extending fasteners 26, the trash bars 2 preventing trash from entering the casting or casing 18.

In accordance with the present invention, a tubular downward extension 28 constructed of shape retentive, but resilient material is provided and includes transversely spaced front and rear apertured mounting ears 30 projecting from its upper end. The mounting ears 30 include lower end portions 32 embedded in the front and rear walls 34 and 36 of the extension 28 and apertured upper ends which are received within the slots 22 and receive the fasteners 26 therethrough in order to mount the upper end of the extension from the lower end of the casing or casting 18. Of course, the conventional trash bars 24 previously mounted in the slots 20 are removed prior to the reception of the ears 30 in the slots 20 and reinstallation of the fasteners 26 through the ears 30 to mount the upper end of the extension from the lower extremity of the casting or casing 18.

The front and rear walls 34 and 36 of the extension 28 are provided with slots 40 corresponding to the slots 20 and additional fasteners 42 corresponding to the fasteners 26 are utilized to secure the opposite ends of the original trash bars 24 in the slots 40.

Of course, replacement fasteners 26 and 42 as well as new trash bars may be provided when modifying the water pump 14 to include the downward extension 28.

Inasmuch as the extension 28 forms a downward extension of the downwardly opening water inlet casing or casting 18 of the water jet pump 14, the water jet pump 14 is mounted from the transom 12 in elevated position thereon such that the lower end of the extension 28 is disposed at substantially the same level as the lower end of the casing or casting 18 before the mounting of the extension 28 on the casting 18. In this manner, operation of the water jet pump is not altered.

However, inasmuch as the extension 28 is constructed of resilient material and projects only slightly below the bottom 16, should the modified water jet pump strike an underwater object in shoal water, the shock of impact will be cushioned insofar as the casting or casing 18 is concerned. Therefore, expensive and time consuming replacement of the casing 18 is avoided in most cases of impact of the modified water jet pump 14 striking an underwater object.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with an outboard-type of water jet pump including a tubular downwardly opening water inlet casing, a tubular extension constructed of shape retentive, but resilient material mounted to and forming a downward extension of said casing, said inlet casing including front and rear walls equipped with downwardly opening slots, said tubular extension includng an upper end mounted from said casing, said upper end including upwardly projecting apertured mounting ears received in at least some of said slots, and fastener means secured transversely through said front and rear walls, slots and mounting ears.

2. The combination of claim 1 wherein said tubular extension includes a lower end and incorporates front and rear walls, said front and rear walls of said extension including downwardly opening slots spaced transversely thereof, a plurality of elongated trash bars, the opposite ends of said trash bars being apertres and received in said slots, and transverse fastener means secured through said front and rear walls of said extension, the last-mentioned slots and the ends of said trash bars disposed in said last-mentioned slots.

3. The water jet pump and extension of claim 1 wherein said mounting ears include lower end portions extending downwardly along and through major length portions of front and rear walls of said extension.

4. The jet pump and extension of claim 1 including a boat having a transom and an aft bottom area intersecting with the lower margin of said transom, said jet pump being mounted from said transom at an elevation with at least substantially all of said casing disposed above said aft bottom area.

5. The method of operating an outboard-type of water jet pump from the transom of a boat downwardly intersecting with an aft bottom portion of the boat and wherein the water jet pump conventionally includes a downwardly opening water inlet casing whose open lower end is substantially entirely disposed below the level of said aft bottom area, said method including mounting a tubular downward extension on the lower end of said inlet casing constructed of shape retentive, but resilient material and raising said water jet pump on said transom an amount substantially equal to the effective vertical extent of said extension, said open lower end of said water inlet casing conventionally including front and rear walls equipped with transversely spaced downwardly opening slots in which the opposite ends of front-to-rear extending trash bars are removably secured, said method including removal of said trash bars, the mounting of said extension through the utilization of upwardly projecting aperture ears carried by said extension and with said ears received and removably secured in said slots.

6. The method of claim 5 wherein said extension includes a lower end and front and rear walls, the lower ends of said front and rear walls including transversely spaced downwardly opening slots corresponding to the first-mentioned slots, said method including removable securement of the opposite ends of said trash bars in the last-mentioned slots.

* * * * *